United States Patent [19]

Moreiras

[11] Patent Number: 4,577,485

[45] Date of Patent: Mar. 25, 1986

[54] SPLIT BACK DIE SEGMENT

[75] Inventor: Luis Moreiras, Mentor, Ohio

[73] Assignee: Parker-Hannifin Corporation, Cleveland, Ohio

[21] Appl. No.: 564,875

[22] Filed: Dec. 23, 1983

[51] Int. Cl.[4] ..... B21D 41/04; B21D 19/10

[52] U.S. Cl. ..... 72/402; 29/237

[58] Field of Search ..... 72/402, 416, 452; 29/237

[56] References Cited

U.S. PATENT DOCUMENTS

| | | | |
|---|---|---|---|
| 3,417,598 | 12/1968 | Valente | 72/402 |
| 3,626,450 | 12/1971 | Browne et al. | 29/237 |
| 4,306,442 | 12/1981 | Schröck | 72/402 |
| 4,309,892 | 1/1982 | Currie | 29/237 |

FOREIGN PATENT DOCUMENTS

| | | | |
|---|---|---|---|
| 81/00043 | 12/1981 | PCT Int'l Appl. | 29/237 |
| 512335 | 8/1976 | U.S.S.R. | 29/237 |

*Primary Examiner*—Daniel C. Crane

*Attorney, Agent, or Firm*—Joseph B. Balazs

[57] ABSTRACT

An improved die segment for crimp machines in which a plurality of such segments are disposed in a bowl to surround a coupling to be crimped, with crimping being effected by forced movement of the die segments toward a narrowed end of the bowl, typically by a hydraulic ram. Each of the segments is wedge shaped having a cylindrical inner face adapted for engagement with the cylindrical sleeve of the coupling and a relatively large conical outer face matching the shape of the conical bowl and adapted for engagement therewith for positioning the array of die segments and for guiding movement of the die segments radially inwardly. The outer face of each die segment is split into spaced, axially extended, contact surfaces which provide improved alignment and force transmission characteristics.

10 Claims, 6 Drawing Figures

SPLIT BACK DIE SEGMENT

BACKGROUND OF THE INVENTION

This invention is related to crimping machines for contracting the collar of a hose coupling onto a hose end and more particularly to the crimping dies of such machine.

In the crimped form of coupling essentially the entire collar of the hose coupling is engaged by the crimping equipment and reduced in diameter to secure the hose end between the couping collar and an insert member of the coupling. This is done typically in a single operational step, requiring only radially inward movement of the collar.

This form of crimping apparatus is well known and is described in some detail in U.S. Pat. No. 4,309,892. In this patent a hydraulic ram is used to drive a circular array of die segments toward the narrow end of a tapered bowl, causing a simultaneous radial inward movement of the die segments and a contraction of the die opening at the center of the array. With the collar of a hose coupling positioned within the die opening, radial inward deformation is effected to secure the coupling on the hose end.

Enormous forces are encountered in crimping machines of this type which, for example, for two inch diameter hose couplings, may require about 200 tons of force from the hydraulic ram to perform the crimping operation. In driving the die segments into the tapered bowl, the axial movement of the dies is converted into a radial contraction by the camming action of the wall of the bowl. In U.S. Pat. No. 4,309,892 the die segments are supported and spaced in a circular array prior to crimping, by a die separator. This is a tubular device with a serrated edge adapted to receive a complementary angled surface at the bottom of each die segment. The die separator is fitted at the narrow end of the bowl and is spring biased to move with the die segments during the crimping operation. Due to the great forces involved, however, the die separator provides little more than an initial locating and guiding of the segments. Once the hose collar is contacted by the die segments and radial deformation begun, continued circular spacing and linear motion of the die segments is dependent upon stability of the structures involved, distribution of forces, frictional effects, and the like. One device employed in the prior art to assure simultaneous movement of the die segments into the bowl, is a spacer ring which is disposed on the segments and which transmits force of the ram to all of the segments.

While prior art crimping machines can produce satisfactory crimped couplings, on occasion difficulties have been encountered which have resulted in less than satisfactory crimped hose ends. In the prior art structures the outer surface of the die segments is a conical surface generally matching the conical surface of the bowl in which it is disposed. However, since the die segments move axially with respect to the bowl there is only one location where a true match between the surfaces is obtained. In other locations, as would be expected at the intersection of conical surfaces of matching slope but different diameters, only a line of contact occurs. This results in a relatively unstable structure subject to the requirement that a great quantity of force must be transmitted through the relatively small surface area. In actual practice, some flattening of this line of contact occurs to accommodate these forces, however such deformations are not always predictable, nor do they result in much more stable structures.

What does occur is that the die segments move relatively unpredictably since they are not constrained entirely in their motion. Thus they may become angled within the bowl, either being cocked or rocked about their initial line of contact, with respect to their desired axial line of movement through the bowl. Under some conditions, to a limited extent, the line of movement of the die segments through the bowl may even be somewhat helical.

The instability of prior art structures could produce undesirable results. For example, galling or surface damage could occur to the die segment or to the bowl structure. With rocking of the die segments uneven contraction of the coupling collar could occur. In some instances a domino-like effect of cocked die segments produces a ratcheted or sprocket-like effect on the coupling collar. Since integrity of the coupling is dependent to a great extent upon concentricity of the crimped collar with respect to the hose and the insert of the coupling, uncertain results could be obtained.

SUMMARY OF THE INVENTION

Many of these undersirable characteristics of prior art crimping machines are alleviated by the apparatus of the instant invention. Essentially this is achieved by a modification of the die segment outer surface structure wherein a split back or double bearing surface structure is provided for each die segment. Such bearing arrangement provides essentially two surfaces of contact where previously there was one. These two spaced surfaces all but eliminate the tendency for the die segment to unpredictably shift within the bowl. The at least doubling of surface contact area reduces significantly the force intensity in localized areas both of the die segments and the bowl and reduces the likelihood for galling or damage to the surfaces, while greatly increasing the life expectancy of the components. Still further, with the dual bearing pads provided in a circumferentially spaced configuration there is a greater tendency for the die segments to track axially toward the narrow end of the bowl rather than to slip sideways. In net result with all die segments of a plural die segment array having such improved contact surface areas, there is provided a more dependable structure which will provide improved coupling results in a more consistent manner.

DESCRIPTION OF THE INVENTION

Figure 1:
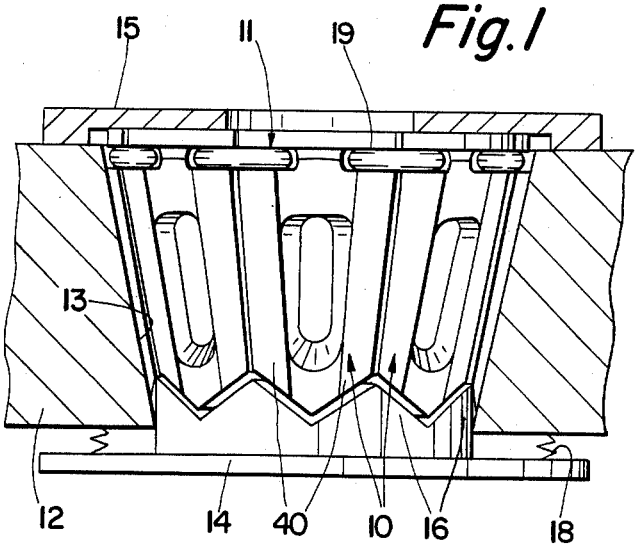
FIG. 1 is a side view of an array of die segments of the invention shown disposed partly in cross-section with respect to the bowl and other components of a crimp machine.
Figure 2:
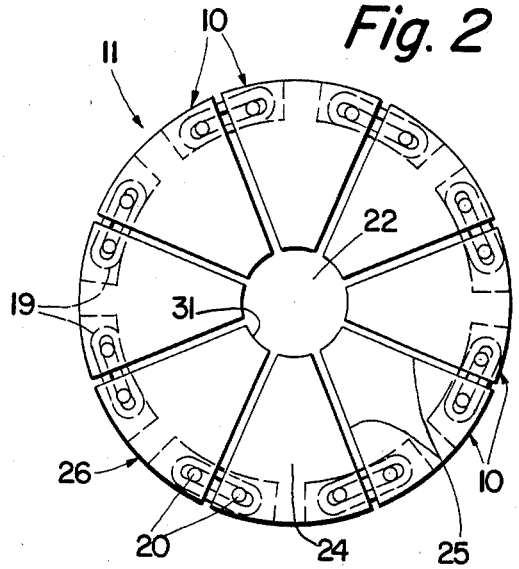
FIG. 2 is a plan view of an array of die segments, shown removed from a crimp machine.
Figure 3:
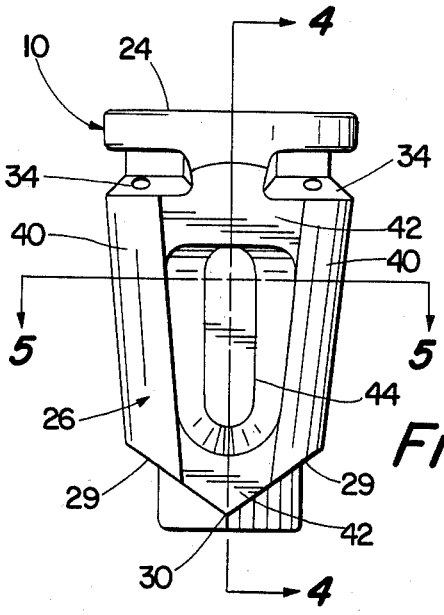
FIG. 3 is a back view of one of the die segments of the invention.

In the drawings the die segment 10 of the invention is shown individually in FIGS. 3–6 and assembled in a die segment array 11 in FIGS. 1 and 2. The array 11 in FIG. 1 is shown disposed in the tapered opening 13 of bowl 12 of a crimp machine, supported on a die separator 14 and engaged by a spacer ring or pusher plate 15. A more detailed description of a crimping machine describing the function of the die separator 14, spacer ring 15 and the like may be had by reference to U.S. Pat. No. 4,309,892, assigned to the assignee of the instant invention, whose description is incorporated by reference herein.

The die segment array 11 is arranged to surround the collar of a hose fitting and to radially constrict the collar onto a hose end inserted therein. This is accomplished by driving the array toward the narrow end of bowl 12 by means of hydraulic force through the intermediacy of spacer ring 15 until the latter engages the top surface of bowl 12, thereby limiting the crimp diameter at a predetermined dimension. The die segments 10 in the array 11 are provisionally supported in a spaced circular configuration by interengagement of angled surfaces at the bottom of the die segments with mating angled projections 16 of die separator 14, the latter being supported from bowl 12 by means of springs 18.

The die segments 10 are loosely affixed to one another by links 19 disposed in slots or notches in the upper portion of the die segments 10 and secured by pins 20. The projecting portion of die separator 14 is tubular and spacer ring 15 is apertured so that the hose and the coupling to be attached thereto may be received or removed from the center of the assembly. The die segment array 11 is shown in FIG. 1 and 2 substantially in the position assumed at the completion of a crimp, however, prior to this the die segment array is in a more elevated position, supported on die separator 14, with the back surfaces of the die segments 10 in engagement with the bowl 12. As the die segments 10 are driven toward the narrow end of bowl 12, die separator 14 is forced axially outwardly of the narrow opening of bowl 12 and the die segments 10 are radially constricted. Movement of the die segments 10 is guided primarily by reaction of the surface of bowl 12, engagement with spacer ring 15 and engagement with the collar of the hose coupling to be crimped. Die separator 14 supplies primarily only an initial spacing of the segments in the array 11 until the above-mentioned surfaces are engaged and then is merely wedged outwardly of the opening of bowl 12 against the relatively light bias of springs 18.

The tapered opening 13 or inner surface of bowl 12 is generally of frusto-conical configuration as is the back surface of die segments 10. However, because of the relative axial movement therebetween there is only one position where a general match of these surfaces can be achieved. This is selected to be near the crimp completion position, depicted in FIG. 1, since this is the position where the highest crimping forces are likely to be encountered and where it is necessary to have the greatest contacting surfaces for effective force transmission without distortion of the respective parts. In more elevated positions of array 11, essentially only line contact occurs between die segments 10 and bowl 12 and it is this contact which guides, in part, the movement of the die segment and transmits the crimping force. Rocking, cocking or skewing of the die segments can occur during this transit resulting in damage to the die segments 10 or bowl 12 or imperfect crimps upon the hose collar. The die segments 10 of the instant invention are configured to minimize these effects to a great extent and to achieve more reliable crimping results.

Referring more particularly to FIGS. 3–6, each die segment 10 consists of an integral metal casting generally in the shape of a segment of a frusto-conical solid having a central opening 22. The segment 10 includes a flat generally wedge-shaped upper surface 24; a pair of radially converging side faces 25 which are axially disposed and which orthogonally intersect upper surface 24; a complex back or outer surface 26 which intersects upper surface 24 and side faces 25; a lower structure which includes a flat taper surface 28 between side faces 25 and angled surfaces 29, the latter meeting at a generally radially oriented ridge 30 and disposed between taper surface 28 and back surface 26, forming a circumferential location surface; and a generally cylindrical inner crimping surface which is axially oriented and which intersects upper surface 24, side faces 25 and taper surface 28.

When arranged in an array 11 as shown in FIGS. 1 and 2 it will be noted that angled surfaces 29 are nestled between projections 16 of die separator 14 for circumferential spacing of the segments; that the back surfaces 26 are in engagement with bowl 12; that upper surfaces 24 are substantially co-planar, this being assured by engagement with the flat underside of spacer ring 15; that side faces 25 of adjacent die segments 10 are substantially parallel and radially disposed; and that inner crimping surfaces 31 describe a cylindrical opening 22 adapted for receipt of the collar of a hose coupling. Notches 34 are provided adjacent the upper, outer corners of each die segment 10, which in cooperation with notches of adjacent die segments provide slots for receipt of links 19 and pins 20 for loosely securing adjacent die segments 10. By this arrangement the die segments are relatively free to move between expanded and constricted positions in the array 11 and may be retained as a unit when removed from or replaced in bowl 12.

Figure 4:
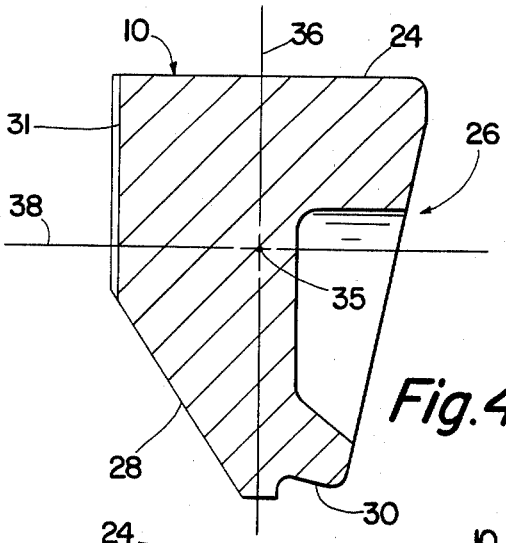
FIG. 4 is a cross-sectional view of the die segment of FIG. 3, taken along the line 4—4.
Figure 5:
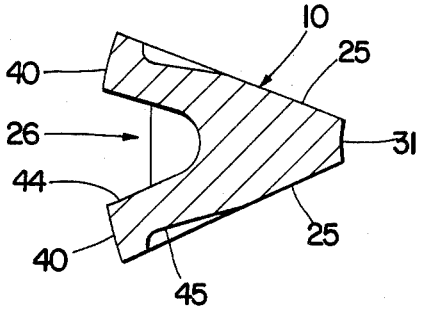
FIG. 5 is a cross-sectional view of the die segment of FIG. 3, taken along the line 5—5.
Figure 6:
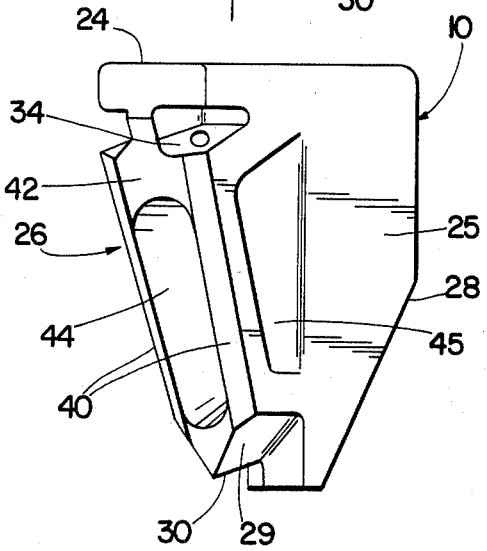
FIG. 6 is a perspective view of one of the die segments of the invention.

Orthogonal axes 35, 36, 38 are depicted in the cross-sectional showing of die segment 10 in FIG. 4 to indicate the types of undesired movement that the segments might encounter in transit between upper and lower or provisional and crimped positions in bowl 12. Axis 35 is orthogonal to the plane of the drawing. Rocking movement of die segment 10 could occur about axis 35, this being a generally radial displacement of the segment. A cocking movement can occur about axial axis 36, this being an angular displacement of the segment from a true radial dispostion as shown best in FIG. 2. Such movement tends to disturb adjacent die segments 10 and can result in a ratcheted effect at the crimped collar. Movement about radial axis 38 produces a similar ratcheting effect upon the finished crimped collar and similarly affect adjacent die segments. Movement about radial axis 38 also tends to cause a helical transit of the die segments between upper and lower positions, whereas a true linear or axial movement is desired. In the past these unpredicatable die segment movements which can comprise any combination of those described, were accentuated by the primarily single line contact between generally conical die segment outer surfaces and conical bowl surfaces, which achieved registration in generally only a single position and this at the completion of the crimping motion.

The back surface 26 of the die segments 10 of the instant invention overcomes these faults to a great extent in the provision of dual contact surfaces for each die segment. Back surface 26 comprises generally conical contact surfaces 40 at either edge of die segment 10, intersecting adjacent side faces 25. Contact surfaces 40 are sections of a cone having a taper generally matching the taper of bowl 12 such that when die segments 10 are received in bowl 12 in a full crimp position as depicted in FIG. 1, substantially full contact will be made between surfaces 40 and bowl 12. In more elevated positions, less than full contact occurs, resulting in more of a line contact, but in this instance two surfaces of contact are achieved to provide a more stable support within bowl 12. In actual practice, due to the great forces involved, the lines of contact are realized as areas of contact and a relatively stable support can be achieved.

The center portion of back surface 26 is a flat surface 42 intersecting contact surfaces 40 and which is recessed to be free of contact with bowl 12. A still further deep recess 44 is provided in flat surface 42 primarily as a weight and material savings device as this portion of die segment 10 provides no other function. Further similar recesses 45 are provided in side faces 25 for a similar reason. Thus a pair of contact surfaces 40 extending in a generally radially and axially converging disposition are provided on each die segment 10 to provide a superior support and guidance structure. It is readily evident that movement about axial axis 36 of FIG. 4 is substantially prevented by this more stable structure, and similar improved effects are obtained to prevent movement about the axes 35, 38, resulting in a more stable structure, more controlled movement and superior final crimped hose collars.

What is claimed is:

1. An array of die segments arranged in a circle in a tapered bowl of a crimping machine, said tapered bowl being defined by a bowl surface having a narrower end relative to an opposite end with the ends being located along an axis, said die segments arranged in said bowl for axial movement toward the narrow end of the bowl and radial contracting movement directly toward the center of the bowl without angular shifting of adjacent die segments for radially contracting the collar of a hose coupling onto a hose end, each die segment comprising a wedge-shaped body member having a radially outer surface in engagement with said bowl surface, a radially inner surface adapted for engagement with the collar of said hose coupling, converging side surfaces connecting said inner and outer surfaces in a wedge configuration, lower and upper surfaces intermediate said inner and outer surfaces for respectively seating said die segment and for receiving axially applied force for moving said die segment relative to said bowl, said radially outer surface comprising a pair of spaced contact surfaces extending substantially between said upper and lower surfaces, and a central surface intermediate and radially recessed from said contact surfaces, said central surface being free from contact with said bowl and structure external of said surfaces of said die segment, such that said die segment is unguided at said central surface during movement relative to said bowl, and means for moving said array of die segments simultaneously toward the narrow end of said bowl with all of said spaced contact surfaces in continuous contact with said bowl surface.

2. The apparatus set forth in claim 1 wherein said contact surfaces have a conical curvature matching the conical curvature of said bowl and said contact surfaces on each said die segment are convergent.

3. The apparatus set forth in claim 2 wherein said central surface is flat and further including a recess in said central surface extending into said body member.

4. The apparatus set forth in claim 3 further including a recess in each converging side surface adjacent said recess in said central surface.

5. An array of die segments arranged in a circle in a tapered bowl of a crimping machine said tapered bowl being defined by a bowl surface having a narrower end relative to an opposite end with the ends being located along an axis, said die segments arranged in said bowl for axial movement toward the narrow end of the bowl and radial contracting movement directly toward the center of the bowl without angular shifting of adjacent die segments, each die segment comprising a pair of conical, outer spaced surfaces contracting said bowl surface, and a central surface intermediate and radially recessed from said outer surfaces, said central surface being free from contact with said bowl and structure external of said surfaces of said die segment, such that said die segment is unguided by means other than said bowl at said outer surfaces, during movement relative to said bowl, and means for moving said array of die segments simultaneously toward the narrow end of said bowl with all of said spaced outer surfaces in continuous contact with said bowl surface.

6. The apparatus set forth in claim 5 wherein adjacent die segments are interconnected to form a chain of die segments.

7. The apparatus set forth in claim 6 wherein said moving means comprises a plate engaging all of said die segments in said array to move said die segments as a unitary structure toward the narrow end of said bowl.

8. An array of die segments arranged in a circle in a tapered bowl of a crimping machine, said tapered bowl being defined by a bowl surface having a narrower end relative to an opposite end with the ends being located along an axis, said die segments arranged in said bowl for axial movement toward the narrow end of the bowl and radial contracting movement directly toward the center of the bowl without angular shifting of adjacent die segments for contracting the collar of a hose coupling, each die segment comprising a body member having a cylindrical inner surface adapted for engagement with the collar of said hose coupling, said inner surface extending substantially parallel with the central axis of said hose coupling, a wedge shaped upper surface extending transversely to said axis from said inner surface radially outwardly, a pair of outer surfaces of conical curvature extending downwardly in a radially converging direction toward said inner surface from a location adjacent said upper surface to a location further downward than said inner surface, a central surface intermediate and radially recessed from said outer surfaces, a taper surface extending downwardly and radially outwardly toward said pair of outer surfaces, from the lower edge of said inner surface, a pair of said surfaces intersecting said upper, inner, outer and taper surfaces, said pair of said surfaces converging radially inwardly, and a locator surface forming the bottom of said die segment intermediate said taper surface and said pair of outer surfaces, said locator surface serving to support and space said die segment in a circular array with other die segments, said central surface being free from contact with structure external of said die segment such that said die segment is unguided at said central surface, and means for moving said array of die segments simultaneously toward the narrow end of the bowl with all of said outer surfaces in continuous contact with said bowl surface.

9. The apparatus set forth in claim 8 further including weight relieving recesses in said pair of side surfaces and between said pair of outer surfaces.

10. The apparatus set forth in claim 9 wherein each said die segment is an integral metal casting.

* * * * *